United States Patent [19]

Rhee

[11] 3,949,493

[45] Apr. 13, 1976

[54] PROTECTIVE SHOE

[76] Inventor: Jhoon Goo Rhee, 2525 N. Ridgeview Road, Arlington, Va. 22207

[22] Filed: Aug. 4, 1975

[21] Appl. No.: 601,440

[52] U.S. Cl. ..... 36/2 R
[51] Int. Cl.[2] ..... A41D 17/00
[58] Field of Search ..... 36/2 R, 7.1 R, 7.3, 2.5 R, 36/1.5, 2 A, 2 B, 8.1

[56] References Cited

UNITED STATES PATENTS

| | | | |
|---|---|---|---|
| 2,541,738 | 2/1951 | Bassichis | 36/8.1 |
| 2,657,477 | 11/1953 | Winslow | 36/2 R |
| 2,814,887 | 12/1957 | Hockley | 36/2.5 A |
| 3,769,722 | 11/1973 | Rhee | 36/2 R |

*Primary Examiner*—Patrick D. Lawson
*Attorney, Agent, or Firm*—Millen, Raptes & White

[57] ABSTRACT

The invention relates to a protective shoe adapted to protect the foot of the wearer thereof engaging in the arts of karate, kung fu, etc. The shoe comprises a casing containing an energy-absorbent soft resilient material substantially open at the bottom. A retaining means on the open bottom is provided for aiding in the retention of the shoe on the foot of the wearer. Straps are also provided for aiding in the retention and for tightening the shoe on the foot of the wearer.

6 Claims, 3 Drawing Figures

PROTECTIVE SHOE

BACKGROUND OF THE INVENTION

This invention relates to a protective shoe adapted to be worn on the foot by a person engaging in the arts and sports of karate, tae kwon do, kung fu, kick boxing, etc.

The art of karate, in particular, is a method developed in Japan for defending oneself without the use of weapons by striking sensitive areas on an attacker's body with the hand, elbows, knees or feet. During training in the art and in organized competition, the use of the feet can become badly bruised from extensive use thereof. The present invention provides a novel shoe adapted to prevent injury to the foot and to persons engaging in the art as opponents, etc.

In my U.S. Pat. No 3,769,722 issued Nov. 6, 1973, a karate shoe is described having strap means around the bottom of the shoe to retain the shoe on the foot of the wearer. This invention is an improvement in the karate shoe.

SUMMARY OF THE INVENTION

It is an object of this invention to provide a novel protective shoe for use in the sports of karate, etc., which is designed to protect the wearer's foot and which can be easily slipped on or off the wearer's foot.

Another object of this invention is to provide a novel protective shoe of simplified construction, relatively inexpensive, and which will obviate injuries to the foot of the wearer and to other persons while engaging in the sports of karate, etc.

A further object of this invention is to provide a novel protective shoe which contains retaining means on the bottom of the shoe adapted to receive the wearer's toes and to aid in retaining the shoe on the wearer's foot.

Generally, the protective shoe of the invention comprises an open soled casing of soft, resilient energy-absorbent material shaped to conform generally to the wearer's foot. The bottom portion of the shoe comprises means for retaining the shoe on the foot. The upper portion of the shoe comprises lacing means intended for also retaining and tightening the shoe on the wearer's foot.

Other features and advantages of the invention will become apparent from the following description of a specific embodiment of the protective shoe taken in connection with the drawings.

DETAILED DESCRIPTION OF THE INVENTION

Figure 1:
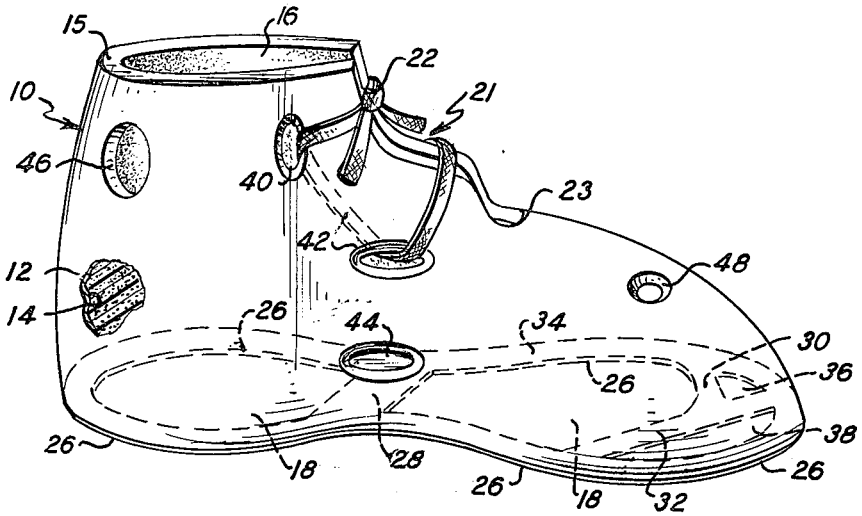
FIG. 1 is a perspective side view of the protective shoe of the invention.
Figure 2:
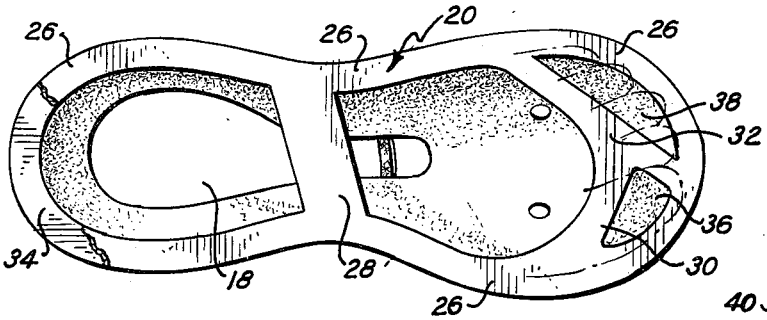
FIG. 2 is a bottom plan view of the protective shoe showing, in phantom, the manner in which the toes of the wearer engage the retaining means on the bottom of the shoe.
Figure 3:
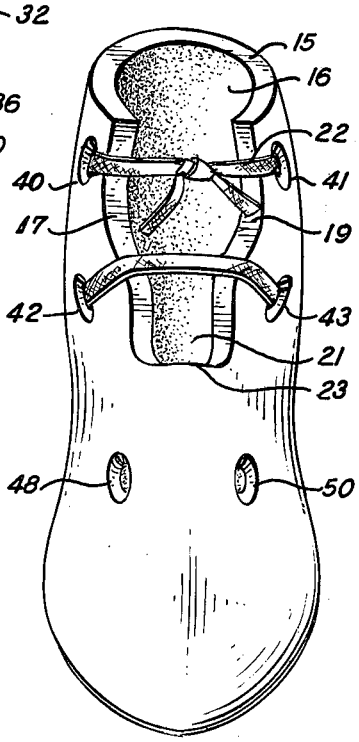
FIG. 3 is a perspective top view of the protective shoe.

The protective shoe of the invention, as shown in a specific embodiment in the drawing, comprises a shoe device generally indicated by the numeral 10 and generally conforming in shape to a person's foot. The device is unitarily molded from a suitable resilient material 12 capable of absorbing energy, such as a plastic foam i.e., polystyrene, polyurethane, or polyvinylchloride foam, etc., or a rubber foam, and the like. A suitable surface coating or casing 14, preferably smooth, covers the entire resilient material throughout. The casing is a tough, pliable, tear resistant, material, preferably of a suitable plastic material or the like. The surface casing 14 can be formed during heating and molding of the resilient foam material to produce a fused coating thereon. Alternatively, the casing 14 can be applied on the surface of the resilient material by dipping or by applying and securing a coating of a suitable plastic material, or the like. Plastic materials are preferred for the casing or coating since there are available on the market many tough, rugged, pliable materials such as polyvinylchloride and the like. However, it is also contemplated within the concept of the invention that suitable rugged leather or fabric materials, and the like, can be used to cover the resilient material. The coating or casing used should provide a flexible, tough covering which is resistant to tearing and abrasion.

The top portion of the device has an opening 16 defined by upper rim portion 15 into which the foot of the wearer can be inserted to permit wearing of the shoe. The shoe device has a generally slit portion 21, defined by side portions 17 and 19, extending from the top portion 15 to an intermediate point 23 of the top of the shoe. The bottom 18 of the shoe is open and thereby the sole of the wearer's foot contacts the floor or ground. This is in keeping with the various sports mentioned wherein the foot is used as a weapon in the contact sports. The bottom 18 of the molded shoe device comprises a peripheral rim 34.

The shoe is retained on the wearer's foot by a relatively thin, unitary, open, retaining means generally indicated by the numeral 20 on the bottom of the shoe, and lacing means 22 laced through holes in the top portion of the shoe. Retaining means 20 comprises a peripheral rim portion 26, cross medial portion 28, and toe portions 30 and 32. The peripheral portion 26 is secured by suitable means to the bottom peripheral rim portion 34 of the shoe. Both respective rim portions 34 and 26 have a width equal to the thickness of the resilient foam and casing. The cross portion 28 is disposed at about the medial portion of the bottom of the shoe and adapted to contact the sole of the wearer's foot. The retaining means is formed from a tough, pliable, preferably plastic, material which is tear resistant and skid-resistant. A fiber or filler reinforced vinyl plastic is preferred. The toe portions 30 and 32 of the retaining means define hole means 36 and curved slot means 38 with the rim portion 26. Hole 36 is adapted to receive the wearer's big toe whereas curved slot 38 is adapted to receive several of the other toes of the wearer.

The shoe is provided with lacing means 22 which lace across the slit portion 21 of the shoe and through lacing slots or holes 40, 41, 42 and 43. The lacing means, when tightened and tied help to snugly retain the shoe on the upper part of the wearer's foot. The shoe is also provided with additional lacing holes or slots such as 44, which permit the shoe to fit both larger and smaller feet. Although lacing means which can be tied are shown, it is within the concept of the invention that elastic straps, straps with "Velcro" material, etc., can be used. "Velcro" is a registered trademark of the Velcro Corporation. Ventilation hole means such as 46, 48 and 50 can also be provided in the shoe device.

The shoe is worn on the foot by loosening the lacing means to enlarge the slit portion 21 and the foot inserted through opening 16. As the foot is being inserted in the shoe, the wearer's big toe is inserted into hole means 36 and several or all of the wearer's other toes are inserted into slot 38. The lacing means are tightened and tied to the comfort of the wearer to secure and retain the shoe on the foot. The medial portion 28 of the retaining means also helps to retain the shoe on the foot. As worn, the bottoms of the heel, sole and toes of the wearer's foot are substantially open.

In use, the protective shoe permits the use of the foot as a weapon in the sports above mentioned, without bruising the foot, or causing serious harm to other persons engaging in the sports. Although the shoe has been particularly described for use in the art of karate, it is understood that the shoe can be worn by contestants in many types of sports such as kick boxing, etc., wherein it is not intended to injure the contestants, and wherein injury to the foot is prevented.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A protective shoe device for use in the art of karate and the like comprising casing means adapted to fit over the top of the foot, an open top portion, a slit portion extending forwardly from said top portion, and an open bottom having a peripheral rim, said casing being tough and pliable and containing resilient means, peripheral retaining means secured to said peripheral rim and comprising a cross medial portion and an adjacent pair of hole means adapted to receive the toes of the wearer of said shoe device, and securing strap means disposed through hole means on both sides of said slit portion.

2. The shoe device of claim 1 wherein said peripheral retaining means comprises a hole adapted to receive the big toe of the wearer and a curved slot adapted to receive the other toes of the wearer.

3. The shoe device of claim 1 wherein said strap means are lace means.

4. The shoe device of claim 1 wherein said strap means are elastic.

5. The shoe device of claim 1 wherein said casing comprises a plastic material, said resilient means comprises plastic foam means, and said retaining means comprises a tough, pliable plastic material.

6. The shoe device of claim 1 wherein said retaining means is a separate unitary member secured to said bottom peripheral rim of said shoe.

* * * * *